US006446617B2

(12) United States Patent
Bianchi et al.

(10) Patent No.: US 6,446,617 B2
(45) Date of Patent: Sep. 10, 2002

(54) INDUCTION MANIFOLD FOR AN INTERNAL-COMBUSTION ENGINE

(75) Inventors: Pietro Bianchi, Turin; Claudio Sparti, Baldissero Torinese, both of (IT)

(73) Assignee: Iveco Fiat S.p.A., Turin (IT)

( * ) Notice: Subject to any disclaimer, the term of this patent is extended or adjusted under 35 U.S.C. 154(b) by 7 days.

(21) Appl. No.: 09/791,926

(22) Filed: Feb. 23, 2001

(30) Foreign Application Priority Data

Feb. 25, 2000 (IT) ..... T0200A186

(51) Int. Cl.[7] ..... F02M 35/104; F02M 25/07

(52) U.S. Cl. ..... 123/568.17; 123/184.47

(58) Field of Search ..... 123/568.17, 568.11, 123/184.24, 184.25, 184.47, 184.48, 184.34, 184.35, 184.42, 184.43

(56) References Cited

U.S. PATENT DOCUMENTS

| | | | | |
|---|---|---|---|---|
| 4,712,519 A | | 12/1987 | Sugahara et al. | |
| 5,427,080 A | * | 6/1995 | Maeda et al. | 123/568.17 |
| 5,537,965 A | * | 7/1996 | Topfer et al. | 123/184.47 |
| 5,572,919 A | * | 11/1996 | Czadzeck | 123/568.17 |
| 6,009,863 A | * | 1/2000 | Tochizawa | 123/184.47 |
| 6,182,633 B1 | * | 2/2001 | Rauch | 123/568.17 |
| 6,318,326 B1 | * | 11/2001 | Albert | 123/184.42 |

FOREIGN PATENT DOCUMENTS

| | | |
|---|---|---|
| DE | 23 38 459 A | 2/1975 |
| EP | 0 450 530 A | 10/1991 |
| EP | 0 741 242 A | 11/1996 |
| EP | 0 886 063 A | 12/1998 |

* cited by examiner

*Primary Examiner*—Paul J. Hirsch
(74) *Attorney, Agent, or Firm*—Zito tlp; Joseph J. Zito; Kendal M. Sheets

(57) ABSTRACT

An induction manifold for an internal-combustion engine, comprising an elongate main body having longitudinal inner cavity provided with an opening adapted to communicate with the intake orifices of the engine, an inlet duct provided with an air-inlet opening and communicating with the cavity, a feed duct for EGR gases formed integrally with the manifold and comprising a first portion extending inside the main body from an inlet orifice for EGR gases to the air-inlet duct and from a second portion extending inside the inlet duct and provided with an outlet opening in the inlet duct itself, and a baffle disposed in the inlet duct between the air-inlet opening and the outlet opening of the feed duct for directing the air and the EGR gases towards a mixing zone inside the inlet duct and situated at a predetermined distance from the cavity of the main body.

5 Claims, 3 Drawing Sheets

INDUCTION MANIFOLD FOR AN INTERNAL-COMBUSTION ENGINE

The present invention relates to an induction manifold for an internal-combustion engine.

BACKGROUND OF THE INVENTION

In internal-combustion engines it is known to use systems for recirculating gas from the exhaust to the intake (abbreviated in the following to EGR systems, which is the acronym for "exhaust gas recirculation"), for the purpose of reducing the content of nitrogen oxides (NOx) in the exhaust gases.

An important requirement, which is to be met by EGR systems so as to ensure proper operation of the internal-combustion engine, is to supply to the various cylinders a homogeneous mixture of recirculated air and exhaust gases (in the following "EGR gases"). In fact, it is known that inhomogeneous mixing of the EGR gases with the air results in unsatisfactory combustion, with consequent smoky exhaust and emission of particulates.

Known EGR systems normally comprise a recirculation tube connecting the exhaust manifold of the engine to the induction manifold via a flow-control valve. The admission of the EGR gases takes place at the inlet of the induction manifold so as to ensure satisfactory mixing in the manifold itself before admission into the cylinders. However, this involves an increase in the amount of space occupied.

SUMMARY OF THE INVENTION

The object of the present invention is to produce an induction manifold for an internal-combustion engine, which makes it possible to obtain proper mixing of the EGR gases with the air and which, at the same time, is of reduced dimensions and can be produced simply and economically.

Therefore, in accordance with the invention there is devised an induction manifold for an internal combustion combustion engine, comprising an elongate main body provided with longitudinal inner cavity adapted to communicate, in operation, with a plurality of intake orifices of the engine, an inlet duct provided with an air-inlet opening and communicating with said cavity, and means for feeding EGR gases into said inlet duct, characterised in that said means for feeding EGR gases comprise a feed duct formed integrally with said manifold and comprising a first portion extending inside said main body and provided with an inlet orifice for EGR gases at one end of said main body, and a second portion extending inside said inlet duct and provided with an outlet opening in said inlet duct, and baffle means interposed between said air-inlet opening of said inlet duct and said outlet opening of said feed duct for directing the air and said EGR gases towards a mixing zone inside said inlet duct and situated at a predetermined distance from said cavity of said main body.

BRIEF DESCRIPTION OF THE DRAWINGS

Further features of the present invention will be apparent from the following description of one embodiment thereof given non-restrictively by way of example below and with reference to the accompanying drawings, in which.

DETAILED DESCRIPTION OF THE INVENTION

Figure 1:
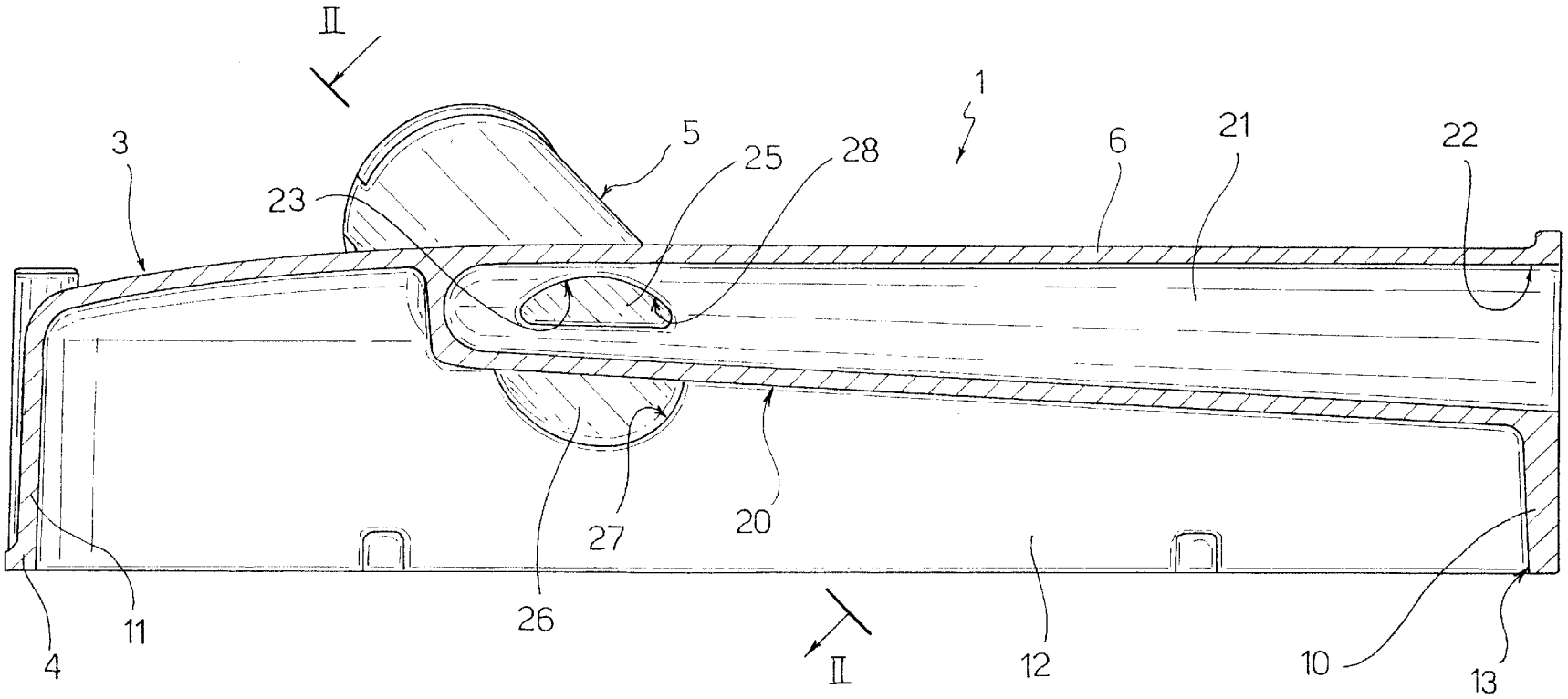
FIG. 1 is a longitudinal section of a preferred embodiment of the manifold forming the subject-matter of the invention.

With reference to the drawings, the reference numeral 1 generally denotes an induction manifold for an internal-combustion engine.

The manifold 1 essentially comprises a hollow main body 3 provided with a flange 4 for connection to the cylinder head 2 (not shown) of the engine, and an inlet duct 5 integral with the main body 3.

The main body 3, which is substantially in the form of an elongate channel, is formed by a bottom wall 6, by a pair of longitudinal walls 8, 9 and by a pair of side walls 10, 11 defining an inner cavity 12 of said body. The cavity 12 is flared towards a front opening 13 which substantially occupies the entire cross-section of said cavity and is surrounded by the flange 4.

The inlet duct 5, which is of tubular substantially cylindrical shape, extends integrally from one (8) of the longitudinal walls 8,9 of the main body 3, arranged upwardly in operation (FIG. 2), in a transverse direction with respect to the cavity 12, and has at one free end an air-inlet opening 15.

The manifold 1 defines integrally a duct 20 for feeding exhaust gas (EGR) into the air-inlet duct 5. The duct 20 is provided inside the manifold 1 and, in particular, comprises a first portion 21 (FIG. 1) which extends along the main body 3 from an inlet opening 22 in the side wall 10 up to the duct 5, and which is of gradually decreasing circular section, and a second portion 23 (FIG. 2) extending along said duct 5 as far as an intermediate zone thereof where it ends in an outlet opening 24. The second portion 23 is separated by a substantially flat wall 25, which extends longitudinally in the duct 5, from a portion 26 of the duct complementary thereto, forming a duct feeding an air-EGR gas mixture to the cavity 12 of the main body 3. The first portion 21 and the second portion 23 of the feed duct 20 are in communication with one another through a passage 28; the duct 26 communicates with the cavity 12 of the main body 3 through a passage 27 (FIGS. 1 and 2).

In the inlet zone of the duct 5 there is provided a baffle 30 interposed between the opening 15 and the outlet opening 24 of the duct 20, for the purpose of promoting proper mixing between the air and the EGR gases, thereby obviating back pressures and turbulence which, without the baffle 30, would be created by the admission of the EGR gases counter currently to the air.

Figure 2:
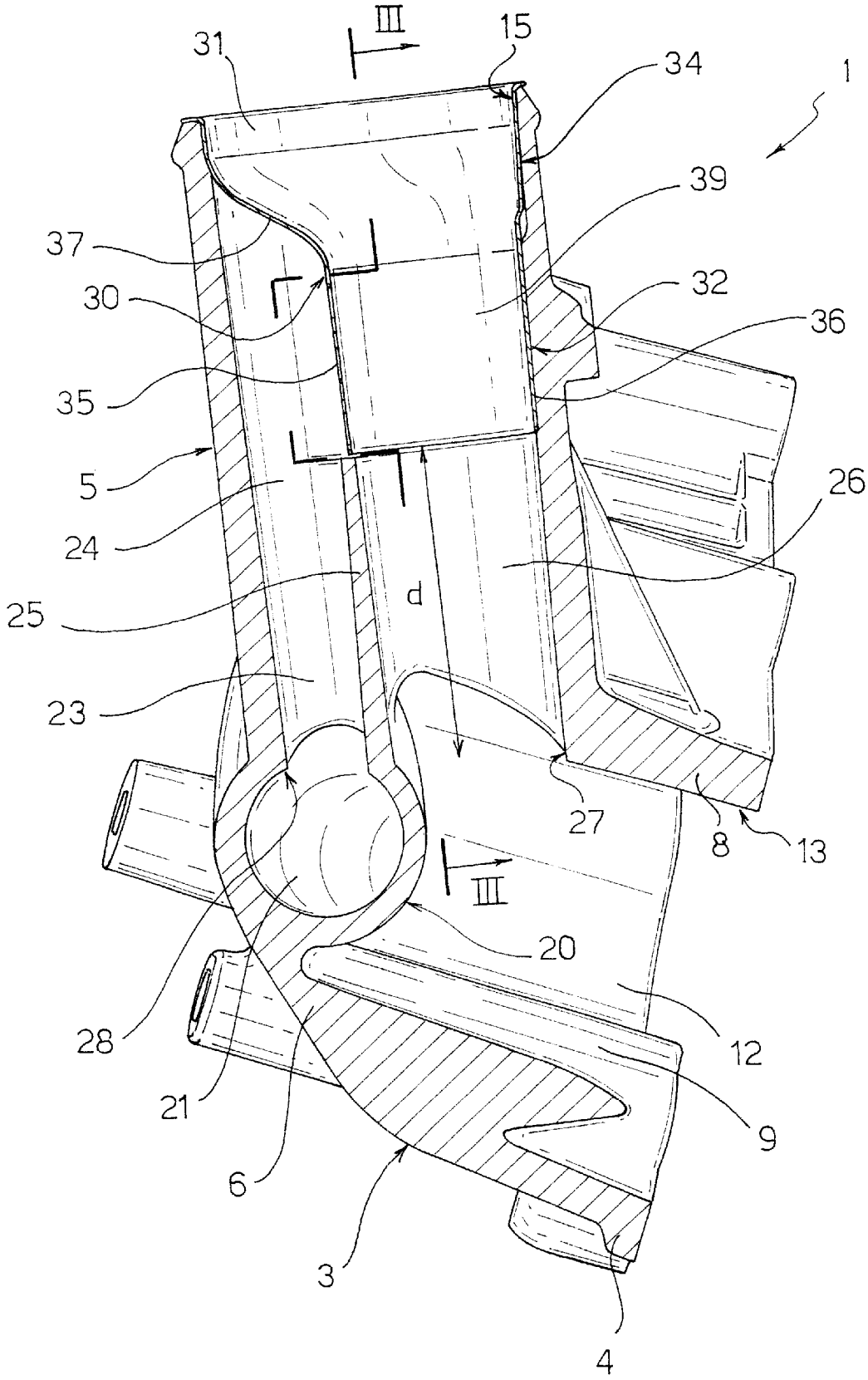
FIG. 2 is a section on an enlarged scale along the line II—II in FIG. 1.

The baffle 30, which is of tubular shape, comprises a first end portion 31 of circular section fitted into the air-inlet opening 15 and a second end portion 32 which is of sectional shape and dimensions substantially equal to the feed duct 26 for the air-EGR gas mixture, and situated opposite this latter so as to form therewith a continuous duct (FIG. 2). Finally, the baffle 30 comprises an intermediate connecting portion 34, the section of which gradually decreases from the first portion 31 to the second end portion 32.

Figure 3:
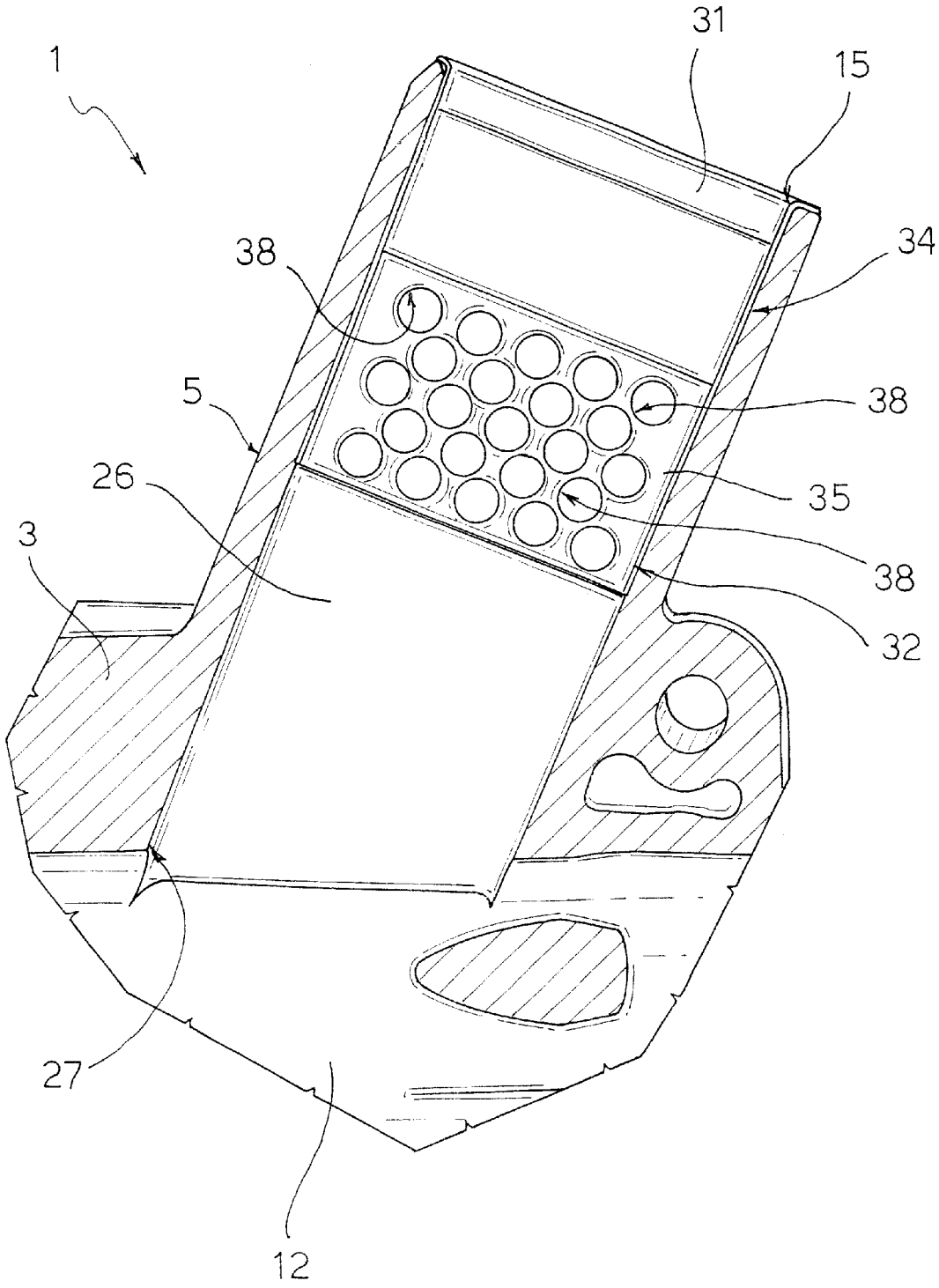
FIG. 3 is a section on an enlarged scale along the line III—III in FIG. 2.

In particular, the second portion 32 of the baffle 30 has a flat wall 35 arranged so as to form an extension of the wall 25, and a cylindrical wall 36 arranged in contact with an inner surface of the duct 5. The intermediate portion 34 has a shaped wall 37 opposite the outlet opening 24 of the second portion 23 of the duct 20, which joins aerodynamically the first portion 31 to the wall 35. The latter is provided with a plurality of hole 38 (FIG. 3) through which the EGR gases from the duct 20 can pass into the inner cavity of the second portion 32, which defines a mixing chamber 39 inside the duct 5 and is arranged at a distance "d" from the cavity 12.

In operation, the air is admitted through the inlet opening 15 of the duct 8 and flows through the baffle 30 towards the cavity 12 of the main body 3. The wall 37 guides the air flow towards the mixing chamber 39 and prevents direct countercurrent mixing between the air and the EGR gases originating from the duct 20. The decrease in passage section for the air in the baffle 30 creates an acceleration and consequent reduction in pressure in the flow of air and promotes, by venturi effect, the return of the EGR gases into the mixing chamber 39. The flow of EGR gases is split up via the holes 38, which further improves mixing with air.

The advantages which can be achieved with the present invention are apparent from a study of the features of the induction manifold 1.

In particular, the duct 20 inside the manifold 1 makes it possible to direct the EGR gases as far as the mixing chamber 39 in the inlet duct 5, without the occupying additional space (tubes, etc.) on the outside of the manifold. The distance "d" between the mixing chamber 39 and the cavity 12 of the main body 3 and the baffle 30 contribute to optimising the mixing of the air and the EGR gases.

Finally, it is evident that the induction manifold for an internal-combustion engine can be subject to modifications and variations which do not depart from the scope of the claims.

What is claimed is:

1. An induction manifold (1) for an internal-combustion engine, comprising an elongate main body (3) provided with longitudinal inner cavity (12) adapted to communicate, in operation, with a plurality of intake orifices of the engine, an inlet duct (5) provided with an air-inlet opening (15) and communicating with said cavity (12), and means (20) for feeding EGR gases into said inlet duct (5), characterised in that said means (20) for feeding EGR gases comprise a feed duct (20) formed integrally with said manifold (1) and comprising a first portion (21) extending inside said main body (3) and provided with an inlet orifice (22) for EGR gases at one end (10) of said main body (3), and a second portion (23) extending inside said inlet duct (5) and provided with an outlet opening (24) in said inlet duct (5), and baffle means (30) interposed between said air-inlet opening (15) of said inlet duct (15) and said outlet opening (24) of said feed duct (20) for directing the air and said EGR gases towards a mixing zone (39) inside said inlet duct (5) and situated at a predetermined distance (d) from said cavity (12) of said main body (3).

2. A manifold according to claim 1, characterised in that said baffle means (30) comprises a first wall (37) interposed between said air-inlet opening (15) and said outlet opening (24) of said feed duct (20), said first wall (37) being shaped so as to define a reduction in passage section for the air from said inlet opening (15) to said mixing zone (39).

3. A manifold according to claim 1, characterised in that said baffle means (30) comprise a second wall (35) which is interposed between said outlet opening (24) of said feed duct (20) and said mixing zone (39), and which is provided with a plurality of holes (38).

4. A manifold according to claim 3, characterised in that said baffle means comprises a tubular baffle element (3) fitted in said inlet duct (5) and forming integrally said first wall (37) and said second wall (35).

5. A manifold according to claim 1, characterised in that said cavity (12) of said main body (3) opens into a single longitudinal opening (13) of said main body (3) surrounded by a flange (4) for fastening to the engine, said cavity (12) being flared towards said opening (13).

* * * * *

UNITED STATES PATENT AND TRADEMARK OFFICE

CERTIFICATE OF CORRECTION

PATENT NO. : 6,446,617 B2 
DATED : September 10, 2002
INVENTOR(S) : Pietro Bianchi and Claudio Sparti It is certified that error appears in the above-identified patent and that said Letters Patent is hereby corrected as shown below:

Title page,
Item [30], Foreign Application Priority Data, delete "T0200A186" and insert -- TO2000A 000186 --.

Signed and Sealed this

Twenty-fifth Day of February, 2003

JAMES E. ROGAN
*Director of the United States Patent and Trademark Office*